United States Patent [19]

Maxwell

[11] 3,950,719

[45] Apr. 13, 1976

[54] PROXIMITY ACTUATED MAGNETIC BUTTON-CONTACTOR ASSEMBLY FOR SWITCHES

[76] Inventor: Palmer M. Maxwell, 522 E. 46th St., Savannah, Ga. 31401

[22] Filed: Aug. 21, 1974

[21] Appl. No.: 499,331

[52] U.S. Cl. ..... 335/205; 335/207

[51] Int. Cl.[2] ..... H01H 9/00

[58] Field of Search ..... 335/205, 206, 207

[56] References Cited

UNITED STATES PATENTS

| | | | |
|---|---|---|---|
| 3,052,778 | 9/1962 | Kathe | 335/207 |
| 3,273,091 | 9/1966 | Wales | 335/207 |
| 3,376,527 | 4/1968 | Risk | 335/207 |
| 3,458,841 | 7/1969 | Davis | 335/207 |
| 3,815,066 | 6/1974 | Vinal | 335/207 |
| 3,859,612 | 1/1975 | Kashio | 335/205 |

*Primary Examiner*—G. Harris

*Attorney, Agent, or Firm*—Jones, Thomas & Askew

[57] ABSTRACT

A miniature type hermetically sealed electrical switch that provides snap-action contact reversal with magnetic contact holding. The only moving part of the switch is a mechanically unattached permanent magnet button-contactor member that reciprocally moves under the influence of an external permanent magnet actuator member to cause reversal snap-action contact of a previous magnetically-maintained contact condition.

14 Claims, 18 Drawing Figures

PROXIMITY ACTUATED MAGNETIC BUTTON-CONTACTOR ASSEMBLY FOR SWITCHES

CROSS-REFERENCE OF RELATED PATENTS

The present invention is directly related to the following prior inventions by the present inventor that are disclosed in the following United States Patents:

A. U.S. Pat. No. 3,397,372, entitled "PROXIMITY ACTUATING MEANS FOR MICROSWITCHES." This invention discloses a known type of lever-operated microswitch assembly for its contact reversing means, said operating lever having attached at right angle to its movable end the polarized surface of a permanent magnet disc whose other polarized surface of a particular polarity faces outward to angulate opposite the non-magnetic operational window surface of its hermetically sealed housing structure.

B. U.S. Pat. No. 3,325,756, entitled "REMOTELY CONTROLLED MAGNETIC ELECTRICAL SWITCH." This invention discloses a known type of multiple spring-leaf electrical contact structure as its contact reversing means. The operational spring-leaf member of said contact assembly has attached at right angle to its movable end the polarized surface of a permanent magnet disc whose other polarized surface of a particular polarity faces outward to angulate opposite the non-magnetic operational window surface of its hermetically sealed housing structure.

In both of the cited prior inventions, the outwardly faced polarized surface of said housed contactor magnet member is magnetically coupled with the polarized surface of an externally positioned permanent magnet disc proximity actuator member whereby said surfaces are contour matched at a mid-position of travel between two side disposed limits of travel that provide a partial overlapping of said polarized surfaces. There are two embodiments for polarity orientation as follows:

a. A coupling of polarized surfaces of unlike polarity to provide operation by magnetic attraction, wherein said magnet members move in the same direction in unison along a common line of travel when the actuator magnet member is moved to cause contact reversal. The actuator magnet member must be mechanically locked to maintain contact condition, and therefore there are only limited indications for its use, one such embodiment being its application in part for the multiple position rotary switch embodiment disclosed in U.S. Pat. No. 3,325,756.

b. A coupling of polarized surfaces of like polarity to provide operation by magnetic repulsion, wherein said contactor magnet member moves in an opposite direction in the common line of travel with the actuator magnet member when the latter is reciprocally moved between side disposed limits of travel to cause snap-action reversal of magnetically locked electrical contact condition.

The exact understanding of such a magnetic repulsive induced snap-action contact reversal is essential for proper understanding of the scope of the present and the cited prior inventions. When the actuator magnet member is moved from a side disposed limit of travel that provides partial overlapping of said polarized magnet surfaces wherein there is a positive locked electrical contact condition, there will be an increase of said magnetic holding force until the point of travel is reached that provides a contour matching of said polarized surfaces. The slightest further travel of said actuator magnet member will trigger a snap-action movement of both said magnet members to their respective opposite limits of travel of partial contour overlapping of said polarized surfaces and a reversed magnetically locked electrical contact condition. It should be stressed that said polarized surfaces of the coupled magnets be of like diameter to achieve proper contour matching. It should also be stressed that the proper orientation and movement of said magnet members be maintained in a consistent plane of travel since the repulsive magnetic forces of such a coupling of polarized surfaces of like polarity is unstable and there is a persistent effort of said contactor magnet member to flip over or to move in any possible direction that will relieve such an unstable magnetic condition; if such movement is not restrained there will be an erratic and intolerable electrical contact mating. This condition may be further enhanced by a change of gravitational force caused by change of switch position. The lever-arm attachment of the permanent magnet contactor member of the cited prior inventions provides the above-stated requirements of orientation and movement of said contactor magnet member.

The present invention reveals an attachment means for a permanent magnet button-contactor member that provides the above stated requirements of orientation and movement of said contactor magnet member to assure proper electrical contact mating. The present invention provides a mechanically unattached permanent magnet button-contactor member that is magnetically held in a manner that simulates in theory and in fact the same stability of movement that would be provided by a lever-arm attachment of infinite length.

SUMMARY OF THE PRESENT INVENTION

Prior to any discussion of the present invention it is desirable that the term "miniature type" permanent magnet button-contactor assembly be discussed as related to the present invention; the cylindrical hermetically sealed housing module of said contactor assembly provides a mounting cavity for said assembly that is approximately one-half inch in diameter and one-fourth inch deep, for example, although it will be seen that these dimensions are by way of example and are not limitations of the present invention.

The main object of the present invention is to provide an improved permanent magnet contactor switch assembly that is induced to reciprocally move and provide snap-action reversal of magnetically locked contact condition by the influence of a movable external and proximal permanent magnet actuator member.

Another object of the present invention is to provide a variety of embodiments for permanent magnet proximity actuator assemblies that are housed within hermetically sealed housing and mounting structures that may be combined with said miniature type contactor modules to provide electrical switch assemblies that may be operated under adverse environmental conditions.

Another object of the present invention is to provide an improved permanent magnet button-contactor assembly that has a known means for magnetic arc-suppression that is desirable for D.C. switch operation.

Another object of the present invention is to provide said permanent magnet button-contactor assembly within a hermetically sealed housing module that has near its external electrical contact connectors a means to mount known types of solid-state transistors or other integrated circuit devices.

Another object of the present invention is to provide said miniature type permanent magnet button-contactor assembly mounted within a cavity provided by the plastic housing of a solid-state switching device that requires external switching of a bias condition to control its switching function. Such an assembly is switched by proximately-located external magnetic means.

Another object of the present invention is to provide for the multiple stacking of a plurality of said permanent magnet button-contactor modules in combination with a hermetically sealed housing and mounting module of a push-pull knob proximity actuator magnet assembly.

Another object of the present invention is to provide a multiple stacking of four permanent magnet button-contactor modules in combination with a hermetically sealed housing and mounting module of a dual-magnet push-pull type permanent magnet proximity actuator embodiment that may be connected to provide single-pole triple-throw contact operation.

Another object of the present invention is to provide a permanent magnet button-contactor assembly that is mounted within a hermetically sealed housing and mounting structure that will provide a snap-action contact reversal with a sustained magnetic contact holding when it is induced to reverse contact condition by a first magnetic actuator member that is positioned to reciprocally slide between limits-of-travel within a closed parallelepiped cavity of a housing segment provided directly opposite a nonmagnetic operational window surface separating it from the magnetic button-contactor member. Said first actuator magnet member is induced to move and cause a reversal of magnetically locked contact condition by the momentary placement of a second actuating magnet member proximal to and opposite side disposed operational zones on its outer housing window surface.

These and other objects of the present invention will become apparent from the following detailed description and the drawing pertaining to disclosed embodiments of apparatus according to the present invention.

DISCLOSURE OF THE EMBODIMENTS

Figure 1:
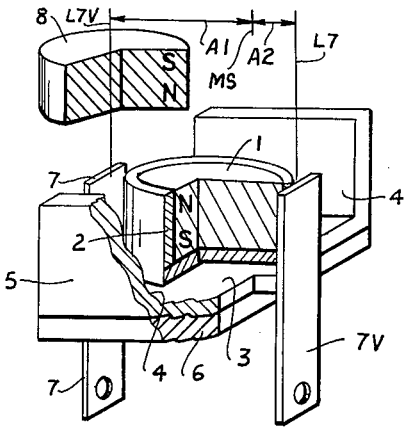
FIG. 1 is an isometric view in partial section showing the unhoused and exploded component parts of the single-throw "on-off" embodiment of the permanent magnet button-contactor assembly and the externally mounted proximity actuator magnet member positioned in proper relationship.

Prior to any detailed description of the various embodiments of the present invention it should be understood that a snap-action reversal of contact condition with a magnetic locking of contact condition is provided by all disclosed embodiments of the permanent magnet button-contactor assembly that is incorporated in the several types of switch structure described herein. It should also be understood that in all embodiments of a complete switching device as in the present invention, the magnetic button-contactor must be combined with an appropriate mounting and with proximal magnetic actuator means in the manner described elsewhere in the drawing and specification, with such exemplary embodiments of an actuating means providing mechanically unattached, slideable button, push-pull knob, toggle-lever, or the like which will provide the required movement of an actuating proximal magnet member between limits-of-travel with orientation and coupling to the magnetic button-contactor member in the disclosed manner.

Figure 2:
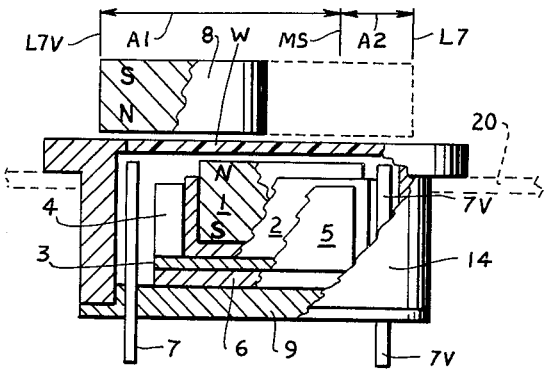
FIG. 2 is a side elevation view in partial section showing the switch embodiment of FIG. 1 mounted within a flanged cylindrical hermetically sealed structure, showing an external permanent magnet proximity actuator member positioned in an "off" operational zone, and a diagram of the magnetic forces involved to provide a snap-action contact reversal when said actuator member is moved to the "on" operational zone.

The switch embodiments shown in FIG. 1 and in FIG. 2 are the same except that FIG. 2 includes a housing member; the latter Figure will be described in detail and shows a permanent magnet disc contactor member 1 that is magnetized along its axis to provide polarized end surfaces of unlike polarity N and S. The magnet member 1 is encapsulated on its periphery and one end-polarized surface S by an electro-conductive button-contactor member 2 positioned to slide in contact with the inner-bottom surface 3 of an electro-conductive grooved rectangular channel member 5 and with loose contact with the button member peripheral surface and side segments 4 of said channel member 5. There is attached to the outer-bottom surface of channel member 5 a wafer of magnetic material 6 that is contour matched with said channel member surface.

The above assembled magnetic button-contactor assembly is mounted on a flanged cylindrical and non-conductive base member 9 with an electro-conductive shaft member 7V passed through said base with its upper segment connected with an open end surface of said channel member 5 and extended upward to provide a limit-of-travel stop for said button-contactor member at an off electrical contact condition and with its outwardly extended segment providing an electrical contact connection means. An electro-conductive shaft member 7 is passed through said base member 9 to provide a fixed electrical contact means for the mating with the peripheral contact surface of button-contactor member 2 when the latter is in an on contact condition, and the shaft member 7 is spaced a distance from the facing open-end of said contactor channel member 5 to provide the required electrical contact spacing in an off contact condition. The said base mounted contactor assembly is mounted within the cavity of a flanged cylindrical hermetically sealed housing structure 14 with its polarized surface N of contactor magnet member 1 faced to move opposite the outwardly positioned non-magnetic operational window W that is provided by said housing member 14.

A permanent magnet proximity actuator magnet member 8 is shown placed in an operational zone on the operational window W of said housing member 14 that will provide the required limit-of-travel L7V for an off contact condition of partial overlapping between the polarized surface N of said actuator magnet member 8 and the facing polarized surface N of the said contactor magnet member 1. When said actuator magnet member 8 is moved from its off limit-of-travel L7V in a common line of travel with contactor magnet member 1 to a distance A1, there will be an increased magnetic holding force to maintain contact condition until a point of travel MS that provides a contour matching of said polarized surfaces of the magnetically repulsive coupled magnet members. The slightest further movement of said actuator magnet member will trigger a snap-action movement of both said magnet members to a reversed overlapping of polarized surfaces wherein said actuator magnet member is moved a distance A2 to its contact on limit of travel L7 thereby inducing a magnetically locked on electrical contact condition.

The mechanically unattached magnetic button-contactor member 2 is maintained in a slidable electrical mating with the bottom conductive surface 3 of channel member 5 by the magnetic holding force between the polarized surface S of magnet member 1 and the wafer of magnetic material 6. The purpose of such a compensating holding force is to neutralize the counter forces of the repulsive magnetic coupling between said contactor magnet 1 and the proximity actuator magnet member 8 that are provided to cause snap-action contact reversal; such counter force, if not corrected, would cause an attempted flip-over of said contactor magnet with erratic mating of the slidable contact surfaces. The compensating force also provides a force to compensate for gravitational forces that would affect said contact condition. If said compensating magnetic force is too great, there will be an impaired slidable movement of said button-contactor member 2; the proper magnetic compensating holding force is the minimum force that will compensate for the above stated disruptive counterforces, and this is provided by selection of permeable material of a mass and thickness that will provide such a holding force.

Such a compensating magnetic holding force does not compensate for the disruptive lateral counter force of said button-contactor member 1 to relieve its unstable condition. The lateral counter force is used to advantage since this force assures slidable contact mating between the peripheral surface of button-contactor member 2 and the side segment 4 of the electroconductive channel member 5 that provides a common electrical connection means to the contacting device. Such a function of the button-contactor member 2 obviously requires that the button-contactor member be of a circular configuration to assure a proper slidable contact without undue friction and binding. All of this detail is provided to show the nature of the invention which assures consistent slidable contact mating of component members without any mechanical attachment of its single moving component member.

Figure 3:
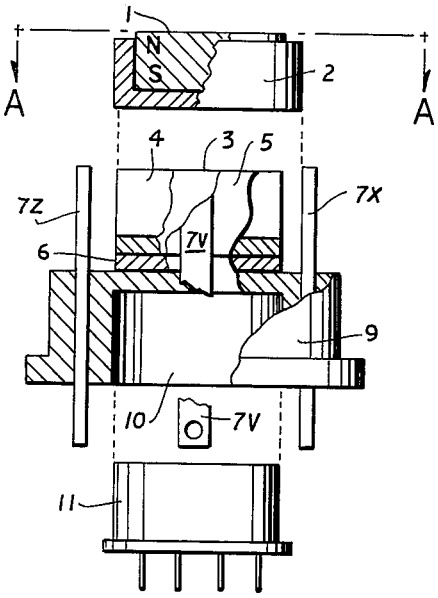
FIG. 3 is an exploded side elevation view in partial section showing the component members for a double-throw embodiment of the permanent magnet button-contactor assembly of the present invention mounted on a cylindrical base that also provides a mounting cavity means to receive a known type of solid-state device.
Figure 4:
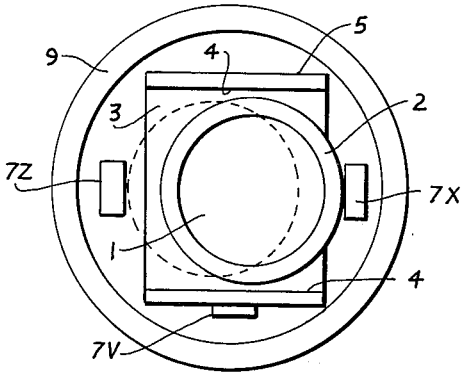
FIG. 4 is a plan view of FIG. 3 taken in plane *a—a*.

FIGS. 3 and 4 show the double-throw embodiment for the permanent magnet button-contactor assembly of the present invention that is mounted on a cylindrical base, wherein there is provided a permanent magnet disc contactor member 1 that is magnetized along its axis to provide polarized surfaces of unlike polarity N and S. Said magnet member is encapsulated on its periphery and one end polarized surface S by an electro-conductive button member 2, positioned to slide in contact with the inner-bottom surface 3 of an electro-conductive grooved rectangular channel member 5 and with loose contact with its peripheral surface and side segments 4 of said channel member 5. There is attached to the outer-bottom surface of channel member 5 a wafer of magnetic material 6 that is contour matched with said channel member surface; the above assembled magnetic button-contactor assembly is mounted on a flanged cylindrical and non-conductive base member 9 with an electro-conductive shaft member 7V attached to the side wall of said channel member 5 with extension through said base member 9 to provide a common electrical connection means.

Electro-conductive shaft members 7X and 7Z are extended through base member 9 to provide external double-throw electrical connection means and with inner extension to provide electrical contact means. Said shaft contact members are positioned opposite the two open ends of said channel member 5 in such a position to reciprocally mate with the peripheral contact surface of said button-contactor member 2 when the button-contactor member is induced to reverse contact condition by a proximal magnetic actuating means. The said button-contactor assembly is shown with a cavity mounting means 10 for solid-state device 11 in its base. The said contactor will provide a double-throw snap-action contact reversal with magnetic contact holding when it is magnetically coupled with a repulsive magnetic proximty actuating means that has been described for FIG. 2.

Figure 5:
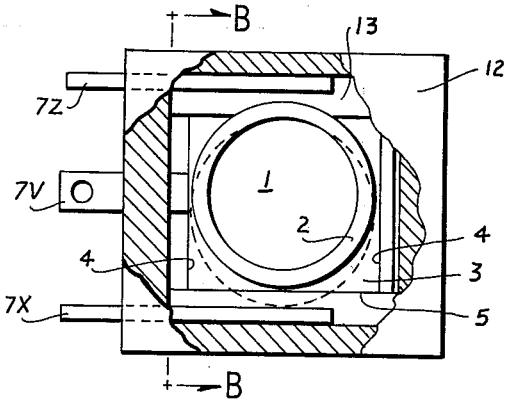
FIG. 5 is a partially sectioned plan view of the operational window surface for a wafer shaped hermetically sealed housing module that houses a double-throw embodiment for the permanent magnet button-contactor assembly of the present invention.
Figure 6:
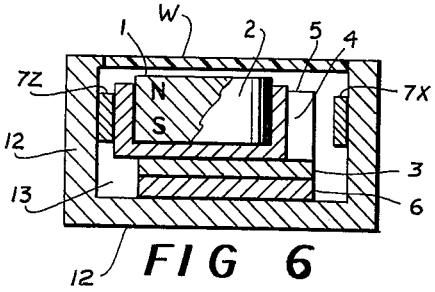
FIG. 6 is a section view of the double-throw contactor module of FIG. 5 taken along the line *b—b*.
Figure 7:
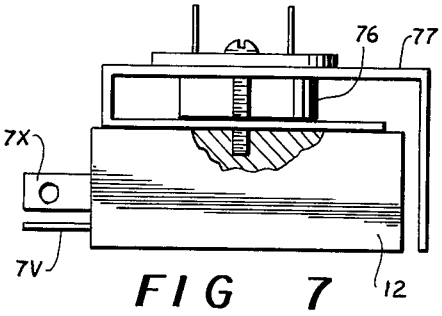
FIG. 7 is a side elevation view in partial section of FIG. 5 showing the placement of a known type of solid-state transistor device and its special heat-sink.

FIGS. 5, 6, and 7 show a double-throw embodiment of the permanent magnet button-contactor assembly of the present invention that is mounted within a wafer shaped hermetically sealed housing module; said Figures reveal a permanent magnet disc contactor member 1 that is magnetized along its axis to provide polarized surfaces of unlike polarity N and S. Said magnet member is encapsulated on its periphery and one polarized surface S by an electro-conductive button-contactor member 2. Said button-contactor member 2 is positioned to slide in contact with the inner-bottom surface 3 of an electro-conductive grooved rectangular channel member 5 and with loose contact with its peripheral surface and side segments 4 of said channel member 5. There is attached to the outer-bottom surface of channel member 5 a wafer of magnetic material 6 that is contour matched with said channel member surface; the above assembled magnetic button-contactor assembly is mounted within the cavity 13 provided by a wafer-shaped hermetically sealed housing module 12 with the polarized surface N of said contactor magnet member 1 faced outward to move opposite a non-magnetic operational window surface W of said housing module 12. A shaft of electro-conductive material 7V is joined with the side surface of channel member 5 and externally extended to provide a common electrical connection means. Electro-conductive shaft members 7X and 7Z are positioned opposite and parallel to the open end surfaces of channel member 5 with a spacing to allow a reciprocal contact mating with the contact members 7X and 7Z with the peripheral contact surface of the button-contactor member 2 when it is induced to reverse contact condition by a proximal magnetic actuating means of the type disclosed elsewhere herein for the present invention. A known type of solid-state transistor 76 and its heat-sink 77 are indicated proximal to its external electrical connection means.

Figure 8:
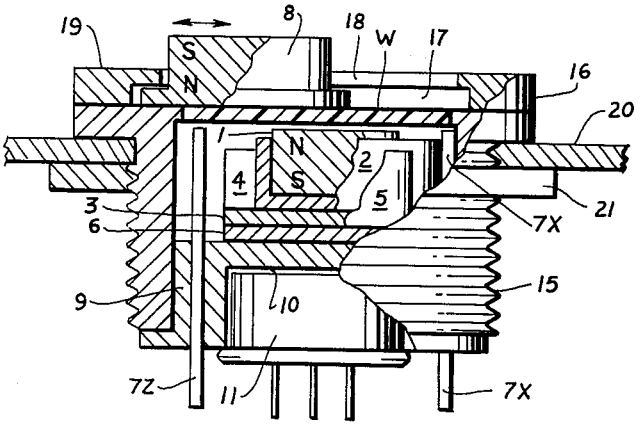
FIG. 8 is a side elevation view in partial section showing the double-throw embodiment of a permanent magnet button-contactor assembly of the present invention indicated by FIG. 3 mounted within a flanged and screw-threaded cylindrical hermetically sealed housing module, with a slidable-button proximity actuator member mounted on its external operational window surface. The switch structure of FIG. 8 provides an external housing mounting for the permanent magnet actuator member which requires manual force for reciprocation between side disposed limits-of-travel to trigger reversal of electrical contact condition.

FIG. 8 indicates a double-throw embodiment of the permanent magnet button-contactor assembly shown by FIG. 3 that is mounted within a cylindrical flanged and screw-threaded hermetically sealed housing and mounting member 15, said housing member 15 is mounted through an opening in a panel member 20 and secured by a lock-nut 21, wherein the inner end of said contactor and its mounting member is isolated from any unfavorable environmental condition that the operational window of said switch assembly might be subjected to. The permanent magnet disc actuator member 8 that is magnetized along its axis to provide polarized surfaces of unlike polarity N and S is press-fitted into a thin ring member 19 for slidable movement between limits of travel within a cavity 17 and slot 18 of a mounting member 16 that is attached to the operating window surface W of said housing and mounting assembly 15. The polarized surface N of said actuator magnet member 8 is faced opposite a polarized surface N of the said contactor magnet member 1 for operation by magnetic repulsion when said actuator magnet member is reciprocally moved between its limits of travel to provide a snap-action reversal of contact condition with magnetic locking in the manner previously described. A known type of solid-state device 11 is shown mounted within the cavity 10 of the base member 9. Such a hermetically sealed switch structure will provide safe operation under adverse environmental conditions for a wide variety of applications.

Figure 9:
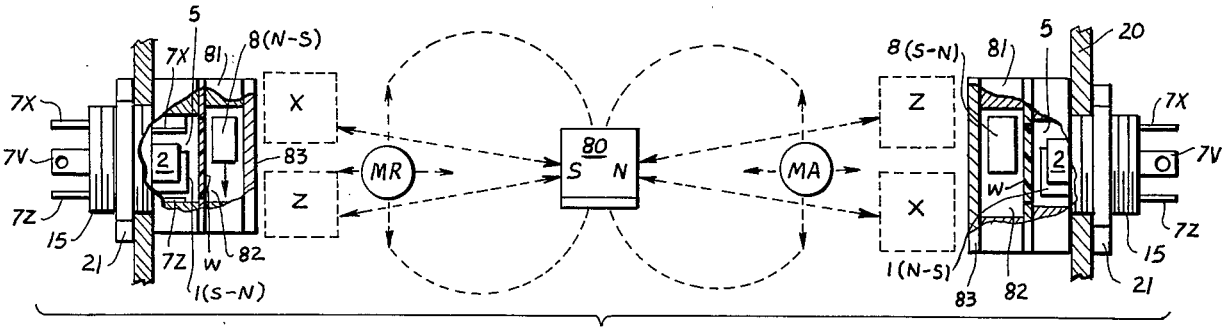
FIG. 9 reveals an embodiment of switch structure according to the present invention, which is a modified version of the switch structure shown in FIG. 8. The embodiment of FIG. 9 replaces the manual movement means with a housing cavity-mounted permanent magnet actuator member which is reciprocated to trigger contact reversal by the proper momentary placement of an appropriate magnetic field zone on the operational window surface in a manner diagrammatically indicated on the drawing. Two such switches are shown in FIG. 9 for diagrammatically illustrating switch actuation by magnetic fields provided by external magnetic means.

Referring to FIG. 9 there will be seen another embodiment of the invention that is a structural modification of the switch embodiment according to FIG. 8. Except for the structural attachment of and movement means of the permanent magnet actuator members between required limits-of-travel to induce snap-action electrical contact reversal, the two switches of FIG. 9 are of like structure and operate in the manner that has been described for all switch embodiments of the magnetic buttoncontactor invention; therefore, description will be limited to such modifications as will be apparent on FIG. 9. The drawing indicates two spaced apart switches with diagrammatic representation indicating their mode of operation by the momentary placement of an appropriate magnetic field. Designation of component structural members and mounting means are the same for said FIG. 8 and FIG. 9. The mounting member 16, provided opposite operational window W of housing and mounting assembly 15, and the mounted ring member 19 that enables a slidable manual movement of permanent magnet actuator member 8 between its limit-of-travel, in the switch of FIG. 8, is deleted from an otherwise similar switch structure that is provided by the embodiment of FIG. 9. Referring to FIG. 9, it will be noted that there is substituted, instead of said manually operated actuator magnet member directly opposite window W of a housing segment 81, a parallelopiped cavity 82 of dimensions to assure proper slidable and mechanically unattached movement of a permanent magnet actuator magnet disc member 8 within said cavity between limits-of-travel that will provide reversal of electrical contact condition. Said magnet member 8 has its polarized surface N faced opposite window W to provide repulsive magnetic coupling with the polarized surface N of button-contactor magnet member 1 and with its polarized surface S faced outward to move opposite a non-magnetic operational window 83. Such a switch embodiment can only be actuated by proper placement of a second and momentarily placed magnetic field.

The diagram in FIG. 9 between two facing switches according to the present embodiment indicates a placement, outside any magnetic coupling with said switches, of a permanent magnet member 80 having uni-polar polarized surfaces, with polarized surface N faced opposite the "right" switch and with polarized surface S faced opposite the "left" switch. When polarized surface N of member 80 is momentarily positioned opposite zones X or Z of the right switch, there will be provided forces of magnetic attraction by its coupling with actuator magnet member 8 of the switch. When positioned to the Z operational zone there will be no change of closed 7Z contact condition. When 80 is positioned to the X operational zone, magnet member 8 will be induced to reverse its position by the "pull" of magnetic forces of attraction and thereby cause a snap-action reversal of electrical contact condition whereby there is a closed 7X contact condition; therefore it is apparent that a reversal of the position of magnetic field polarity between said zones X and Z will reciprocally reverse contact condition. When the polarized surface S is momentarily positioned opposite zones X or Z of the left switch, there will be provided forces of magnetic repulsion by coupling with actuator magnet 8 of the switch. When positioned to the Z operational zone there will be no change of closed 7Z contact condition. When positioned to the X operational zone, magnet member 8 will be induced to reverse its position by magnetic forces of repulsion and thereby cause a snap-action reversal of electrical contact condition whereby there is a closed 7X contact condition. Therefore, it is apparent that a reversal of position of magnet member 80 field polarity between said zones X and Z will reciprocally reverse contact condition. It is obvious that the most effective embodiment of said external actuator magnet member should be a bi-polar magnetic member that spans said operational zones X and Z in a manner to provide in combination magnetic forces of attraction and repulsion to induce movement of said housed actuator magnet member 8, said bi-polar magnet to be either a permanent magnet member or a D. C. electromagnet member having a means to cause its polarity reversal.

It will be understood, although not depicted herein, that a plurality of in-line spaced switches as in FIG. 9 and spaced a varied distance apart can be actuated by the progressive placement opposite operational zones of said switches of a plurality of magnetized surfaces of a different polarity and with a varied spacing between said actuating members. Such an arrangement constitutes an improvement over another invention by the present inventor pertaining to the multiple position rotary switch that is disclosed in U.S. Pat. No. 3,325,756. It is also obvious that the FIG. 9 embodiment of the magnetic button-contactor switch device can be also actuated by proximal magnetic polarity reversal provided by a D.C. electromagnet member. Therefore, the button-contactor device of the present invention will provide an improvement over another invention by the present inventor as set forth in U.S. Pat. No. 3,397,372; specifically it would be substituted instead of a magnetically actuated micro-switch shown therein for all relay embodiments revealed in said patent.

Figure 10:
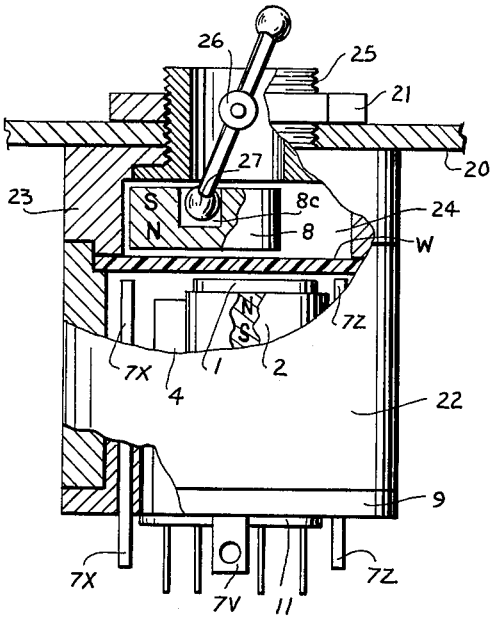
FIG. 10 shows a side elevation view in partial section of the double-throw permanent magnet button-contactor assembly shown in FIG. 3 mounted within a hermetically sealed cylindrical housing module that is joined with and magnetically coupled to the operational surface of a hermetically sealed housing and mounting module for a toggle-lever operated permanent magnet proximity actuator member the movement of which will cause said magnet to induce a reversal of contact condition.

Referring to FIG. 10, there may be seen a single-pole double-throw permanent magnetic button-contactor assembly as indicated by FIG. 3 mounted within a cylindrical hermetically sealed housing member 22 with the outwardly polarized surface N of its contactor magnet member 1 movable opposite the non-magnetic operational window surface W of housing member 22. Said polarized surface N is positioned opposite and magnetically coupled to the polarized surface N of a permanent magnet proximity actuator member 8 that is moved by a toggle-lever member 26 having a lower shaft member 27 positioned within an axial cavity 8*c* of said actuator magnet member 8, wherein said magnet member is reciprocally moved between side disposed limits-of-travel within said cavity 24 of a cylindrical hermetically sealed mounting module 23 that is provided with an axial threaded-bushing member 25 that provides a pivot attachment for said toggle-lever member 26. Said threaded bushing member 25 is positioned through an opening of a panel member 20 and secured by a lock-nut member 21. Said magnetic button-contactor member 1 is induced to reciprocally move and cause a snap-action contact reversal of magnetically locked contact condition in the manner previously described when said actuator magnet member 8 is moved between its limits-of-travel in response to a reversal of toggle-lever angular position. A known type of solid-state device 11 is mounted within a cavity (not shown in FIG. 10) of mounting base member 9. Such an embodiment will effectively provide a hermetically sealed switching device wherein its entire mechanism except its toggle-lever actuator magnet 8 assembly is isolated from any adverse environmental condition to which said switch might be subjected.

Figure 11:
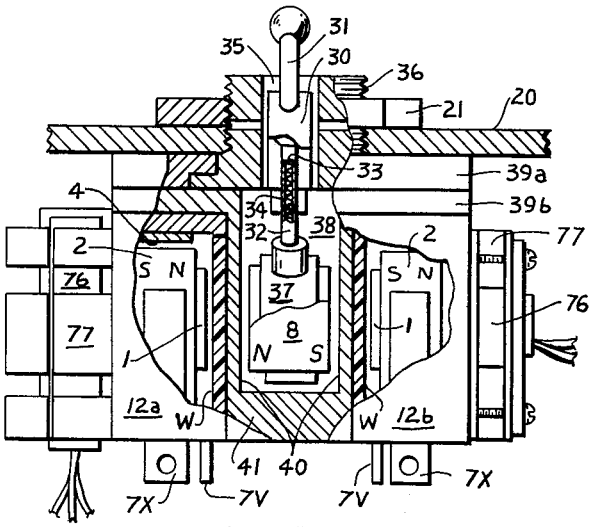
FIG. 11 shows a side elevation view in partial section of the multiple stacking of two double-throw permanent magnet button-contactor assemblies as indicated by FIG. 5 positioned opposite and magnetically coupled with the polarized magnetic surfaces of a toggle-lever operated permanent magnet proximity actuator member that is enclosed within a hermetically sealed housing and mounting module. Such a switch assembly provides double-throw contact operation, and shows two different types of transistors and heat-sinks joined with said contactor members.

Referring to FIG. 11 of the drawing, there is seen a double-pole double-throw switch embodiment that provides the stacking of two permanent magnet buttoncontactor assemblies mounted within the cavities of wafer-shaped hermetically sealed housing modules as indicated by FIGS. 5, 6 and 7. The outwardly faced polarized surface N of the button-contactor magnet 1 of a first contactor module 12A is movable opposite the non-magnetic operational window surface W of said first contactor module 12A. Said contactor module 12A is positioned opposite and magnetically coupled with the polarized surface N of a permanent magnet actuator member 8. The outwardly extended polarized surface S of a second button-contactor magnet member 1 is positioned to move opposite the non-magnetic operational window surface W of said second contactor module 12B. Said contactor module 12B is positioned opposite and magnetically coupled with the polarized surface S of the permanent magnet actuator member 8. Said actuator magnet member 8 has a mounting ring 37 that has a rod member 32 attached with orientations along a diameter of said magnet member. Said rod member is positioned within the axial cavity of a lower-lever arm segment 34. Said rod is slideable movable in opposition to a cavity mounted compression spring member 33 to maintain a straight-line movement of said magnet member in slideable contact with end cavity wall surface when said lever segment 34 is angulated to cause movement of said magnet member between side disposed limits-of-travel in response to the angular reversal of the outer extended pivoted-lever member 31.

The central lever arm segment 30 is pivot mounted within the cavity 35 of a flanged screw-threaded bushing member 36 that is joined with a cylindrical flanged mounting member 39A. Said flanged member 39A is joined with a contour matched cylindrical flange member 39B of a parallelepiped non-magnetic walled hermetically sealed mounting structure 41 with facing operational window surfaces 40 provided by the cavity 38 of said housing structure. Said actuator magnet member 8 is positioned within said cavity 38 wherein its parallel polarized surfaces N and S are faced to move opposite the operational surfaces of said housing structure 41.

When said actuator magnet member 8 is angulated to reciprocally move between its limits-of-travel there will be a magnetic induced movement of magnetic button-contactor member 2 to provide a reversal of magnetically locked contact condition in the manner previously described. Such an embodiment will effectively provide a hermetically sealed switching device wherein its entire mechanism except its toggle-lever actuator magnet assembly is isolated from any adverse environmental condition to which said switch might be subjected.

Figure 12:
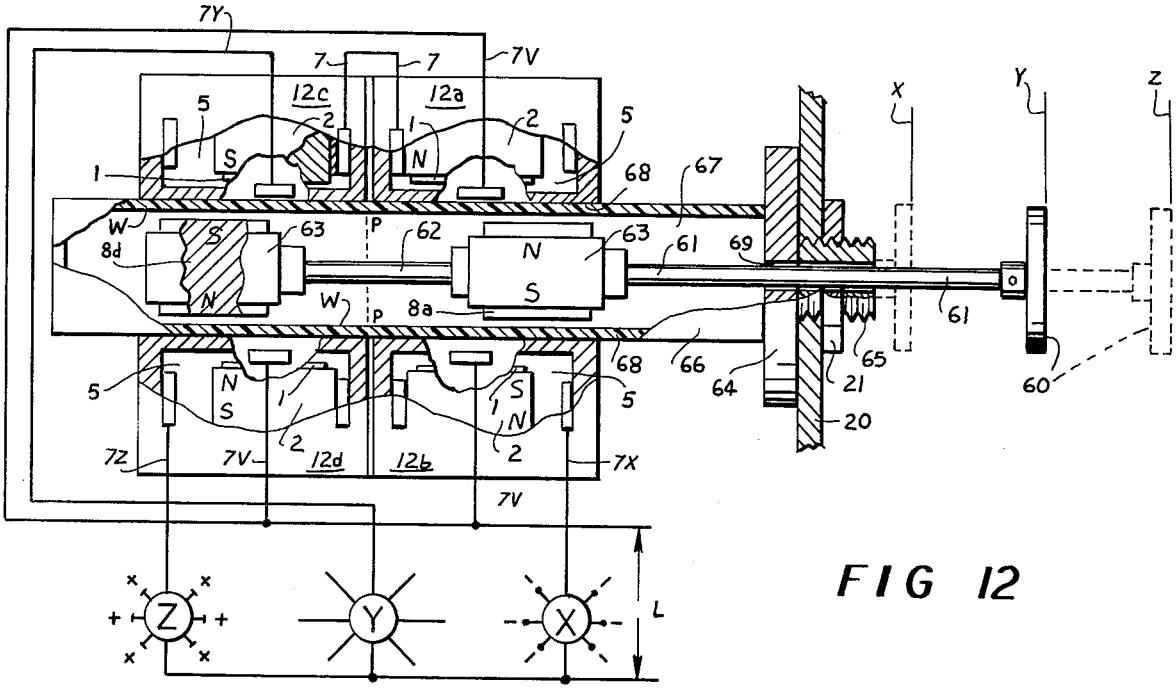
FIG. 12 shows a side elevation view in partial section for the multiple stacking of four double-throw permanent magnet button-contactor assemblies that are housed in hermetically sealed modules as shown in FIG. 5 positioned opposite and magnetically coupled with the polarized magnetic surfaces of a dual-magnet proximity actuator member that is operated by a push-pull knob means, said actuator member enclosed within a hermetically sealed housing and mounting module, such a switch assembly to provide single-pole triple-throw contact operation.
Figure 16:
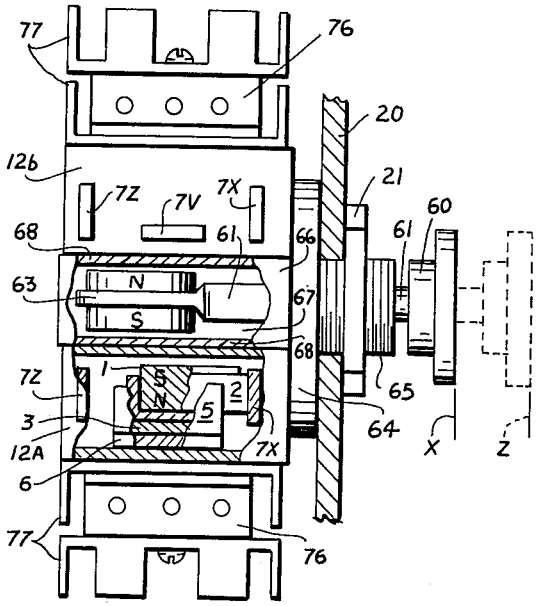
FIG. 16 is a side elevation view, partially sectioned and broken away, indicating the multiple stacking of two permanent magnet button-contactor modules of the type shown in FIG. 5 in combination with a push-pull knob embodiment of the type shown in FIG. 14 that is enclosed within a hermetically sealed housing and mounting module, such a switch provides double-pole double-throw contact operation, and shows known types of power transistors mounted adjacent to its contactor modules.

With an overall reference to FIGS. 12 through 16, the structure and function of the push-pull knob operated type external and proximal magnet actuator means that is common to all figures will be described. FIG. 16 shows a basic embodiment that provides double-pole double-throw switch operation, and includes a permanent magnet disc member 8A having polarized end surfaces N and S and secured within a holding ring member 63 that is joined to a shaft member 61 provided with a knob member 60. A modification of said basic embodiment for the triple-pole double-throw switch embodiment of FIG. 15 includes added magnet members **8*b* and 8*c* positioned with staggered polarized surfaces of different polarity faced in a particular direction, and secured within holding rings 63 with an in-line spaced apart separation by shaft segments 64 and 65 as required for proper actuating travel. A modification of said basic actuator embodiment is also provided for the single-pole triple-throw switch embodiment as shown in FIG. 12, wherein there is added a magnet member 8*d* that is positioned within a holding ring 63 with its polarized surfaces facing in an opposite direction to the polarity of magnet member 8*a*. The holding rings 63 of said magnet members are joined by a shaft segment member 62 as is required to provide a single-pole triple-throw switch operation; such a spacing is different than that of the triple-pole double-throw switch embodiment of FIG. 15.**

All embodiments of the push-pull knob operated proximity actuator member described above are enclosed within a housing and mounting module that is used on all embodiments for a switch structure using this type of magnetic actuator means. Such a housing and mounting module provides the above described single or multiple unit magnet actuating member positioned for slidable movement within the parallelepiped cavity 67 of housing member 66, with the polarized end surfaces N and S of its actuating magnet members 8 positioned opposite the two non-magnetic operational windows 68 provided by such a housing member 66. The actuating shaft member 61 is positioned to slide within the cavity 69 of a screw-threaded bushing member 65 that is integral with a flanged end closure 64; the other end of the cavity 69 is closed to provide a hermetically sealed separation of internally mounted switch members from the external environment when said housing member has its screw-threaded bushing 65 positioned through a barrier panel surface 20 separating the inner and outer environment and with an appropriate gasket member that is secured by a lock-nut 21. An operational knob member 60 is joined with the outer extended shaft member 61. It is obvious that such a hermetically sealed actuator module provides safe operation under explosive or similar adverse environmental conditions when it is operationally joined opposite the magnetic button-contactor device of the present invention in its various embodiments that provide the proper orientation and magnetic coupling revealed herein. Such a push-pull knob operated actuator module can be used in combination with embodiments provided by prior inventions of the present inventor now covered by U.S. patents which are cited herein, and which disclose a similar magnetic coupling between a contactor means and an external proximity actuator means.

The above described hermetically sealed proximity actuator assembly for the push-pull operation of magnetic contactor means will be described in combination with a multiple stacking of the wafer shaped double-throw magnetic button-contactor devices that have been revealed herein, and it will be seen that single-throw embodiments of such devices or cylindrical shaped embodiments of same could be provided by the three specific embodiments to be revealed. Since both said actuating and contactor devices have been revealed in detail, a minimum description for the specific embodiments is required to reveal the operation. Referring to FIG. 16, there will be seen a double-pole double-throw embodiment for a hermetically sealed switch structure that provides in combination the push-pull proximity magnetic actuating assembly that is described above together with two ganged magnetic button-contactor modules of the embodiment indicated on FIGS. 5, 6, and 7. A first such contactor module 12A has its outwardly extended polarized end surface S positioned to move opposite a first operational window 68 of the actuator mounting member 66 with a repulsive magnetic coupling to the polarized end surface S of the actuator magnet member 8A which is slidably movable within cavity 67 between limits-of-travel X and Z. The second polarized end surface N of said actuator magnet member is outwardly faced opposite a second housing operational window surface 68 to provide a repulsive magnetic coupling with the outwardly faced polarized end surface N of the second contactor magnet member 1 provided by a second magnetic button-contactor module 12B that is positioned opposite the said second operational window of the said housing member 66. When the knob member 60 is reciprocally moved between its limits-of-travel X and Z, there is a reversal of magnetically locked contact condition in the manner that has been revealed. Known types of solid-state transistor devices 76 and heat-sinks 77 are shown mounted on said contactor modules for connection with said contactors to provide solid-state switching in a known manner.

Figure 14:
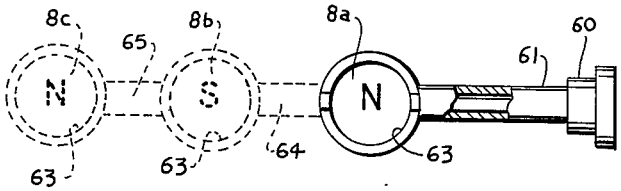
FIG. 14 shows the construction of a single-magnet push-pull knob operated permanent magnet proximity actuator member such as is used in the switch structure of FIG. 16, showing in dotted extension the addition of magnetic members that are indicated for the switch structure of FIG. 15.
Figure 15:
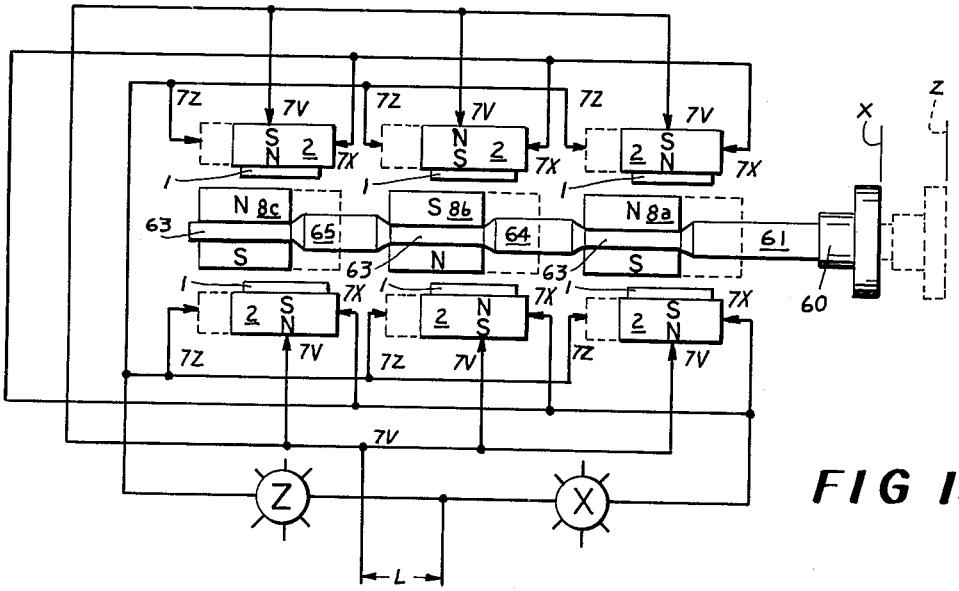
FIG. 15 shows the electrical connection for the parallel operation of a multiple-pole electrical switch that provides a stacking of six permanent magnet button-contactor modules for operation by a push-pull knob embodiment of a triple-magnet permanent magnet proximity actuator member.

Referring to FIG. 15, there is seen a schematic electrical diagram to show the parallel connection of six magnetic button-contactor devices of the present invention that are actuated by a triple magnet proximity actuating embodiment such as is shown on FIG. 14. Such a connection will provide a higher current rating that is only limited by the number of such multiple stacked contactor modules and the required number of actuating magnets that are indicated, a double-pole double-throw switch operation being provided by a paired placement of two button-contactor modules with a magnetic coupling with the two polarized surfaces of unlike polarity provided by each actuator magnet. Each such multiple stacked contactor member is actuated by the repulsive magnetic coupling and movement that has been revealed herein for all embodiments of the present invention. It is obvious that a plurality of ganged contactor modules may likewise be electrically connected to provide a plurality of operational poles that provide a double-throw operation. The overall current rating may also be increased by placement and connection with solid-state switching devices in the manner indicated elsewhere herein. Multiple unit ganged switch operation may also be provided by a substitution of contactor modules that have said magnetic button-contactor means incorporated in an embodiment wherein there is provided a combination of said contactor and a solid-state switching device that is packaged within the same plastic enclosure, such an embodiment being revealed elsewhere herein. The construction of a suitable hermetically sealed housing and mounting module for a push-pull operated multiple position proximity actuator means has been described above, and it is necessary to maintain proper interspacing between shaft members 64 and 65 that separate holding rings 63 of magnet members 8*a*, 8*b*, and 8*c*. It is also important to provide limits-of-travel in both directions within the cavity 67 of housing member 66 when such a multiple-magnet actuator assembly is reciprocally moved by knob member 60 to cause the snap-action reversal of magnetically locked contact condition by a reversal of the direction of partially overlapped polarized surfaces of like polarity as provided by a coupling between the facing polarized surfaces of an actuator member 8 and a contactor magnet member 1. Such a reversal must provide simultaneous movement of the plurality of magnetic button-contactor members 2 in a common direction of travel that will provide simultaneous reversal of the magnetically locked contact condition. The X circuit is on and the Z circuit is off when the knob member is in the solid-line position X, while the circuit switching conditions are reversed when the knob is moved to the broken-line position Z.

Figure 13:
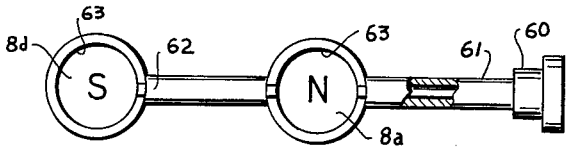
FIG. 13 shows the construction of a dual-magnet push-pull knob operated permanent magnet proximity actuator member such as is provided by the switch structure FIG. 12.

Referring to FIG. 12, there will be seen a single-pole triple-throw embodiment of the present invention that provides a multiple stacking of four magnetic button-contactor modules in combination with a dual-magnet push-pull type proximity actuator module, both of which have been revealed elsewhere in the present specification. Prior to the further disclosure of this embodiment, it should be stated that such a device provides safe operation under adverse environmental conditions, and also provides a snap-action reversal of magnetically locked contact condition at all three of its operational positions. Magnetic holding of contact condition will increase as the actuator magnet member moves the greater part of its travel that provides a reversal of direction for its overlapped polarized magnet surfaces to trigger a snap-action reversal of its magnetically locked contact condition, and all said action is provided without the use of mechanical levers, springs, or indexing mechanism. A dual-magnet push-pull type proximity actuator of the configuration shown on FIG. 13 is mounted within the parallelepiped cavity of a hermetically sealed housing and mounting module in the manner already previously described in detail herein, and is shown in combination with a ganged attachment of four magnetic button-contactor modules of a type indicated by FIGS. 5, 6 and 7 of the drawing. A first magnetic button-contactor module 12A has its operational window surface W positioned and joined opposite a firsst operational window surface 68 of the housing member 66, with the polarized surface N of its contactor magnet member 1 positioned opposite the polarized surface N of a first actuator magnet member 8*a*. A second magnetic button-contactor module 12B has its operational window surface W joined opposite a second parallel and 180° axially spaced apart operational window surface 68 of said housing member 66, with the polarized surface S of its contactor magnet member 1 positioned opposite the polarized surface S of the first said actuator magnet member 8*a*. A third magnetic button-contactor module 12C has its operational window surface positioned and joined opposite the first operational window surface 68 of said housing member 66 with an in-line placement adjacent to the first said magnetic button-contactor module 12A, and with the polarized surface S of its contactor magnet member 1 positioned opposite the polarized surface S of a second actuator magnet member 8*d*. A fourth magnetic button-contactor module 12D has its operational window surface W positioned and joined opposite the second operational window surface 68 of said housing member 66 and with its in-line placement to second magnetic button-contactor module 12B, and with the polarized surface N of its contactor magnet member 1 positioned opposite the polarized surface N of said second actuator magnet member 8*d*.

There is shown on FIG. 12 a broken reference line (*p—p*) which is provided to establish a point-of-reference for the orientation of contactor and actuator magnet members that will provide the triple-throw contact operation. The magnetic button-contactor modules 12A and 12B are paired opposite each other on the right side of reference line *p—p*, as viewed in FIG. 12, with an orientation which provides simultaneous reversal of a double-throw contact condition; likewise, magnetic button-contactor modules 12C and 12D are paired on the left side of *p—p* in a like manner to cause simultaneous reversal of a double-throw contact condition. The drawing indicates the orientation of contactor magnet members and actuator magnet members for a mid-position Y of their operational state; in such an operational state the said first actuator magnet member 8*a* is positioned away from the reference line *p—p* a distance to the right to provide an overlapping of its polarized surface N with the facing polarized surface N of button-contactor member magnet 1, of switch 12*a*, and with overlapping of its polarized surface S with the facing polarized surface S of magnet 1, of switch 12*b*. Repulsive forces are thus provided which cause movement of the button-contactor members 2 of both said contactor modules to establish a contact mating with the contact members 7 of both said contactor modules. The first said actuator magnet member 8*a* is spaced an in-line distance apart from the left-positioned second actuator magnet member 8*d* by a shaft segment 62 joining the holding rings 63 of said actuator magnet members. The length of said shaft segment 62 is critical and must provide proper spacing between said magnet members; such spacing of said magnets is the length that provides a positioning of the second actuator magnet member 8*d* in a direction to the left of reference line *p—p* to provide an overlapping of its polarized surfaces N and S with the polarized surfaces of a like polarity of the facing polarized surfaces provided by the magnet members of contactor modules 12C and 12D. Such an overlapped condition of polarized surfaces causes said contactor magnet members to move towards the "middle" at reference point *p—p* to provide a mating of both said button-contactor members 2 with their respective contact members 7; thus in the mid-position operational condition Y, the button-contactor modules 12A and 12C are adjacent to each other and mated with their respective contact members 7, and the button-contactor modules 12B and 12D are adjacent to each other and mated with their respective contact members 7. The said paired adjacent magnetic button-contactor members 12A and 12C and the other paired adjacent magnetic button-contactor members 12B and 12D provide a magnetic holding between said paired combinations, and to such a magnetic holding force there is provided an additional holding force occasioned by the repulsive magnetic forces between the two actuator magnet members and their coupling with the said contactor magnet members to induce the said contact condition. Said additional force also induces a force to pull said dual actuator magnet assembly in opposite directions from said reference point *p—p* and thereby immobilizes the position of said actuator assembly.

Prior to a further disclosure of the operation of the switch depicted in FIG. 12 at other positions X and Z of its push-pull magnetic actuator movement, it should be emphasized that limits-of-travel for said actuator member in both directions of travel are preferable provided that will maintain the required orientation of magnet members in the manner to be stated hereafter. When knob member 60 is moved from a mid-position Y to a fully extended position X, said actuator magnet member 8*a* is moved to the left, the distance required to provide a snap-action reversal of magnetically locked contact condition when its polarized surfaces N and S are overlapped with the facing polarized surfaces of like polarity that are provided by the paired magnetic button-contactor members 12A and 12B. Such a reversed contact condition provides a mated contact between the button-contactor members 2 and the contact members 7 for both said contactor members. Simultaneously, with said contact reversal of contactor modules 12A and 12B, the actuator magnet member 8*d* moves away from its maximum repulsive magnetic coupling with contactor modules 12C and 12D, and simultaneously the actuator magnet member 8*a* approaches and provides a magnetic attractive coupling with said contactor magnet members that will immobilize same in their present contact condition. The magnetic attractive force between actuator magnet member 8*a* and the two magnet members of contactor modules 12C and 12D, together with the magnetic repulsive force between said actuator magnet member 8*a* and the two magnet members of contactor modules 12 and 12B, are additive in a common direction that maintains the actuator magnet assembly in its X operational condition. When knob member 60 is moved from a mid-position Y to a fully extended position Z, said actuator magnet member 8*d* is moved to the right the distance required to provide a snap-action reversal of magnetically locked contact condition when its polarized surfaces N and S are overlapped with the facing polarized surfaces of like polarity that are provided by the paired magnetic button-contactor members 12C and 12D. Such a reversed contact condition provides a mated contact between the button-contactor 2 and the contact member 7*z* for both said contactor members. Simultaneously with said contact reversal of contactor modules 12C and 12D, the actuator magnet member 8*a* moves away from its maximum repulsive magnetic coupling with contactor modules 12A and 12B and simultaneously the actuator magnet member 8*d* approaches and provides a magnetic attractive coupling with said contactor magnet members that will immobilize same in their present contact condition. The magnetic attractive force between actuator magnet member 8*d* and the two magnet members of the contactor modules 12A and 12B, together with the magnetic repulsive force between said actuator magnet member 8*d* and and the two magnet members of contactor modules 12C and 12D, are additive in a common direction that maintains the actuator magnet assembly in its Z operational condition.

There are a number of possible combinations for electrical connection that will provide different switch operations, with the combination provided in FIG. 12 being for a single-pole triple-throw switch operation. Contactor modules 12A and 12C have their contacts 7 and 7 connected by a jumper; when in the operational position Y, voltage L is connected to contact terminal 7V of contactor module 12A with continuation through an on contact condition to its contact 7 and to contact 7 of contactor module 12C, and through the on contact condition of 12C through its contact member 7Y to a connected load Y. When actuator knob 60 is moved to its X operational position, contactor module 12A is moved by a snap-action reversal to its off contact condition, and a voltage connected to contact terminal 7V of contactor module 12B is continued through an on contact condition to its contact member connection 7X and with a connection to load X; when actuator knob 60 is moved to its operational position Z, contactor module 12C is moved to its off contact condition. A voltage connected to contact terminal 7V of contactor module 12A is continued through an on contact condition to its contact member connection 7Z and with a connection to load Z. It should be stated that said switching device provides a snap-action reversal of magnetically locked contact condition for all of its three operational positions, in the manner revealed elsewhere herein.

Figure 17:
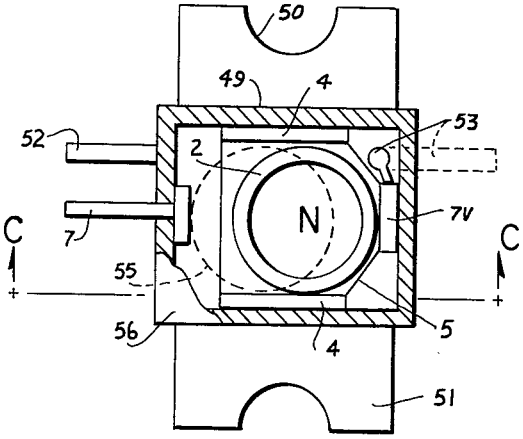
FIG. 17 shows a plan view in partial section of a solid-state switching embodiment of the present invention wherein a miniature magnetic button-contactor device of the present invention is combined with a known type of solid-state transistor device, with both said devices housed within a common plastic package having a non-magnetic operational window in its housing cavity opposite its magnetic button-contactor member as required for an external and proximal magnetic actuation in the manner revealed elsewhere for hermetically sealed actuating and mounting modules.
Figure 18:
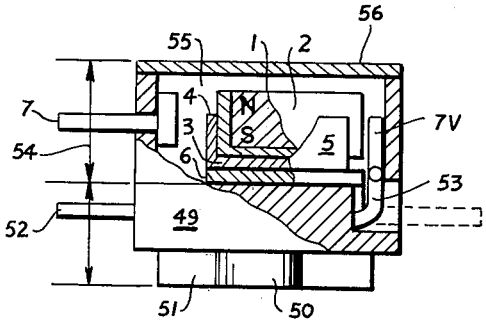
FIG. 18 shows a section view of the switch device shown in FIG. 17 taken along line *c—c*.

This embodiment of the present invention indicated by FIGS. 17 and 18 provides a solid-state integrated package that provides power switching by a solid-state component when a built-in magnetic button-contactor device of the present invention is actuated by proximal magnetic means to cause a reversal of the required bias signal condition within said solid-state device to cause its switching function. Such an embodiment of the invention may be constructed in combination with transistor devices, thyristor devices, or any other solid-state devices that require external control of a voltage or current bias to enable their operation.

Referring to FIGS. 17 and 18 there will be seen a solid-state switching device of the present invention that is embodied in combination with a specific type of transistor device, by way of example to show construction and comparative size relationship of its component members and not by way of limitation. Such a specific type is used because the size of its wafer shaped plastic housing package is a dimension that requires only the addition of an end segment of a depth sufficient to provide a housing cavity for the magnetic button-contactor device, the overall depth being approximately double its normal dimension. A solid-state transistor device of a known type and configuration commonly referred to as "Outline 49" is designated in FIGS. 17 and 18 as 49, said transistor device having its component members housed within a square shaped wafer package having a mounting plate 50 that is also the electrical connection means for its collector member 51. Horizontal electrical connection means are provided for its emitter member 52 and for its base member 53. The plastic housing package of the transistor device is increased in depth a sufficient amount 54 to provide a parallelepiped cavity 55 closed on its end by a non-magnetic operational window surface 56; the magnetic button-contactor device of the present invention is fixedly mounted within cavity 55 with the polarized end surface N of its permanent magnet disc member 1 faced outwardly to move opposite the operational window surface 56. The said permanent magnet disc member 1 is encapsulated on its peripheral surface and one polarized end surface S by an electro-conductive material to provide a button-contactor member 2 which is positioned for slidable contact with the inner-bottom surface 3 of an electro-conductive grooved rectangular channel member 5 and with its peripheral contact surface in loose slidable contact with the side members 4 of said channel member. A thin wafer of permeable magnetic material 6 is contour matched and fixedly attached to the outer-bottom surface of channel member 5 and with said wafer member fixedly attached to the bottom surface of cavity 55. The electrical connector means for the base member 53 is turned upward into cavity 55 and joined with an upturned end segment 7V of channel member 5, said segment 7V also providing a limit-of-travel for the button-contactor member 2 when it is in its off contact position. An electrical contact member 7 has its contact segment mounted within cavity 55 opposite the open end of channel member 5 with a spaced-apart alignment with the peripheral contact surface of button-contactor member 2 when the latter is in its off contact position, and with an electrical contact mating of said contact members when said button-contactor member 2 is induced to move to its on contact condition by external and proximal repulsive magnetic means as disclosed for other embodiments of the present invention. An appropriate voltage-bias connected to terminal 7 and the emitter connection means 52 will trigger control the switching state of the transistor in a known manner when the button-contactor member is induced to move to its on contact condition by said proximal magnetic means. For other embodiments of the solid state switching package of the present invention that include other types of solid-state devices in combination with said button-contactor device of the present invention, there may be substituted a double-throw embodiment of said button-contactor device when such a solid-state device requires a double-throw switching of voltage-bias to enable its switching function.

Such an integrated combination of solid-state switching and the magnetic switch assembly of the present invention should provide the ultimate for certain electrical switching requirements. Its power rating is limited only by the availability of solid-state devices suitable for a combined operation with the miniature magnetic button-contactor device that is incorporated within such a package. Such a package will permit installation in a smaller space than would be required for its separate components; furthermore, there will be required no electrical interconnection between same. The several disclosed embodiments for hermetically sealed proximity actuator modules assure safe operation under adverse environmental conditions. All embodiments of the button-contactor device provide a snap-action reversal of magnetically locked contact condition. Furthermore, all improvements provided by such a package will cost less than would separate components to provide for hermetically sealed operation through the use of presently available means.

It will be understood that the foregoing relates only to disclosed embodiments of the present invention, and that numerous modifications can be made therein without departing from the spirit and the scope of the present invention as defined in the following claims.

What is claimed is:

1. A proximity magnetically actuated electrical switch for selectively making and breaking an electrical circuit, comprising:

a rectangular channel defined by a floor member having an inner surface and an outer surface, a pair of spaced apart parallel sidewall members, and a pair of end wall members;

said side wall members and end wall members being adjacent to and upstanding a distance from the inner surface of said floor member;

said side wall members and said inner surface of said floor member being electrically conductive;

a first circuit connector means electrically connected to said conductive wall members and inner surface for connection with an electrical circuit to be controlled by said switch;

at least one of said end wall members comprising a fixed electrically conductive member mounted in electrically nonconductive relation with said wall members and inner surface;

a second circuit connector means electrically connected to said one end wall member for connection with said electrical circuit;

a cylindrical button contactor member slidably received within said channel;

said button contactor member having a first end disposed on said inner surface of said floor member;

said first end and the circular wall of said cylindrical member comprising a cylindrical capsule of electrically conductive material;

a permanent magnetic member disposed within said cylindrical capsule with a first pole facing toward said inner surface of said floor member and with a second pole of opposite polarity facing away from said inner surface;

the outer diameter of said cylindrical capsule being sufficiently less than the spacing between said side wall members of said channel to permit the button contactor member to freely side between said end members of said channel;

a layer of magnetically permeable material disposed on said outer surface of said channel, and being of sufficient permeability and mass to sustain said cylindrical capsule in sliding electrical contact with said channel;

a nonmagnetic window mounted in spaced apart relation to said floor member inner surface to enclose said channel;

a magnetic actuating member positioned externally of said channel for movement adjacent to and along said window;

said actuating member having a magnetic pole facing said window of the same polarity as said second pole of said button contactor member, so that said actuating member exerts a repulsive force tending to urge said button contactor member for sliding travel along said channel to contact either one of said end members; and switch control means operatively engaging said actuating member to selectively move said facing magnetic pole along substantially the same path of travel which said button contactor member can travel within said channel, so that such movement of the repulsive force of said actuating member causes snap-action movement of said button contactor member into contact with a selected one of said end members.

2. The switch as in claim 1, wherein said rectangular channel is hermetically sealed to isolate the button contactor member and the electrically conductive surfaces from the ambient atmosphere surrounding the switch.

3. The switch as in claim 1, wherein:

both of said channel end members are electrically isolated from each other and from the remainder of the conductive surfaces defining said channel; and including separate circuit connector means connected to each of said end members, so as to provide double-throw electrical operation for said switch in response to said snap-action movement of said button contactor member into contact with one or the other of said end members.

4. The multiple circuit electrical switching apparatus comprising a pair of switches as defined in claim 1;

means mounting said pair of switches with said nonmagnetic windows and said permanent magnetic members in mutually confronting spaced apart relation with each other;

the magnetic actuating member for each of said switches being retained in a rectangular motion guide means which maintains said actuating member adjacent the respective nonmagnetic window and which allows said actuating member to undergo said selective movement; and said switch control means comprises a magnetic control member disposed in the space between said pair of switches and having pole faces aligned in magnetic operative interrelation with said retained actuating members of said pair of switches so that the location of each said magnetic actuating member within its respective retaining means, and thus the position of the respective button contactor members, is controlled by controlling the location within said space of said pole faces of said magnetic control member.

5. The multiple circuit electrical switching apparatus comprising at least two switches as set forth in claim 1;

said switches mounted so that the paths of travel of said button contactor members in each said switch are aligned in a collinear path;

said switch control means comprises an operating member selectively reciprocable along a linear path which is parallel to said linear path of alignment; and said magnetic actuating members for each of said plural switches are connected to said operating member in linear spaced apart relation thereon, so that each of said plural switches is actuated in predetermined sequence as said actuating members are reciprocated along said linear path.

6. The integrated combination of a magnetically actuated electrical switch as set forth in claim 1 and a solid state switching device, comprising:

housing means having a first enclosed chamber within which said rectangular channel and said button contactor member of said electrical switch is enclosed, said nonmagnetic window of said housing means comprising a wall of said first enclosed chamber;

said housing means having a second enclosed chamber;

a solid state switching element received within said second chamber; and said solid state switching device having a switching control circuit element electrically connected to one of said electrical circuit connection means of said electrical switch in said first enclosed chamber, so that said snap-action operation of said electrical switch controls the switching operation of said solid state switching device.

7. The integrated combination as in claim 6, wherein said electrical switch is hermetically sealed within said first enclosed chamber.

8. The switch as in claim 1, in which said switch control means comprises toggle means selectively operative to provide snap-action movement of said actuating member to either of a first position and a second position on said path of travel of said actuating member.

9. The switch as in claim 1, wherein said magnetic actuating member comprises a permanent magnet retained externally of said window for sliding movement along said path of travel of said actuator member.

10. The switch as in claim 1, in which said switch control means comprises push-pull means connected to said magnetic actuating member and selectively operable to move said actuating member along said actuator path of travel.

11. The switch of claim 9, wherein said magnetic actuating member is provided with mounting means positioned adjacent said window to provide sliding movement of said actuating member along said path of travel of said actuating member.

12. The switch as in claim 9, wherein said window is a first such window, said magnetic actuating member is positioned within a closed parallelopiped cavity mounting means defined by a housing which is integral with said switch and contiguous to said first window, said parallelopiped cavity being closed by a second non-magnetic window which is spaced apart from said first window, and magnetic field producing means disposed outside of said parallelopiped cavity to provide a momentary magnetic field at said second window of polarity to induce said magnetic actuating member to reciprocally move within limits of travel defined by said parallelopiped cavity.

13. The switch of claim 12, wherein said magnetic field producing means is a permanent magnet member.

14. The switch of claim 12, wherein said magnetic field producing means is an electromagnetic means.

* * * * *